US005953938A

United States Patent [19]

Tung et al.

[11] Patent Number: 5,953,938

[45] Date of Patent: Sep. 21, 1999

[54] ROLLING DRUM TYPE WASHING STRUCTURE OF A CLOTH WASHING APPARATUS

[76] Inventors: Wan-Chin Tung; Jing-Shing Chern, both of P.O. Box 82-144, Taipei, Taiwan

[21] Appl. No.: 09/122,887

[22] Filed: Jul. 28, 1998

[51] Int. Cl.[6] ..... D06B 1/02

[52] U.S. Cl. ..... 68/5 D; 68/22 R; 68/205 R

[58] Field of Search ..... 68/5 D, 5 E, 22 R, 68/205 R

[56] References Cited

U.S. PATENT DOCUMENTS

| | | | |
|---|---|---|---|
| 2,080,635 | 5/1937 | Schramek et al. | 68/205 R |
| 3,098,371 | 7/1963 | Fleissner | 68/205 R X |
| 3,163,030 | 12/1964 | Woodworth, Jr. | 68/205 R |
| 3,763,672 | 10/1973 | Bahnsen | 68/205 R |
| 3,886,769 | 6/1975 | Conti | 68/205 R X |
| 4,135,373 | 1/1979 | Conti | 68/205 R X |
| 4,180,994 | 1/1980 | Lemon et al. | 68/205 R X |

*Primary Examiner*—Philip R. Coe
*Attorney, Agent, or Firm*—A & J

[57] ABSTRACT

A rolling drum type washing structure of a washing apparatus includes a transmission device including a first roller, a first knife roller and a first conveyor belt connecting the first roller and the first knife roller, a rinsing device including a net drum and two second rollers arranged under the net drum, the two second rollers being drivingly connected with the net drum, three water reservoirs with an open top arranged within the net drum and each pivotally mounted on an axle longitudinally extending across the net drum, and eleven spraying pipes disposed above the net drum and each provided with a plurality of perforations, and a squeezing device including a second knife roller, two third roller, a second conveyor belt, two upper squeezing rollers and two lower squeezing rollers, whereby the cloths are washed one by one thus thoroughly cleaning the cloth.

1 Claim, 5 Drawing Sheets

ROLLING DRUM TYPE WASHING STRUCTURE OF A CLOTH WASHING APPARATUS

BACKGROUND OF THE INVENTION

1. Field of the Invention

This invention is related to a rolling drum type washing structure of a cloth washing apparatus.

2. Description of the Prior Art

The conventional washing machines generally fall into two categories, i.e. the rolling type and the tunnel type. As shown in FIG. 1, the rolling type washing machine includes a rectangular casing 10 in which there is a cylindrical member for receiving bed sheets, tablecloth, clothes and the like to be cleaned. By means of the control panel 11, the cylindrical member will be rotated at a high speed thereby enabling the clothes to be cleaned and dried.

Referring to FIG. 2, the tunnel type washing machine generally includes three washing tubs 20 each provided with a net member 22 pivotally connected at one side thereof. The cloth (such as bed sheets, tablecloths and clothes) to be cleaned is put in the net member 22 of the first washing tub 20 wherein the water containing cleaning agent will be agitated to clean the cloth. After a predetermined period of time, the net member 22 will be rotated through an angle of more than 90 degrees to move the cloth into next washing tubs 20 containing clean water to clean the cloth. However, the above-mentioned two washing machines still suffer from the following drawbacks:

1. The two washing machines are utilizing running water to clean a large amount of cloths at the same time, and so the cloths cannot be cleaned thoroughly as they are cleaned by running water only.

2. The cylindrical member of the rolling type washing machine rotates at a high speed in use thereby producing noise pollution in operation and therefore causing damage to the operator's health.

3. The tunnel type washing machines are used for washing only and so it is necessary to move the cloths with manual power to a drier for drying the cloths thus causing much inconvenience in use.

Furthermore, the cloth after dried must be manually moved to the ironing and folding devices for ironing and folding thus causing further inconvenience in operation.

Therefore, it is an object of the present invention to provide an improved washing structure of a washing apparatus which can obviate and mitigate the above-mentioned drawbacks.

SUMMARY OF THE INVENTION

This invention is related to an improved washing structure of a washing apparatus.

According to the preferred embodiment of the present invention, a rolling drum type washing structure of a washing apparatus includes a transmission device including a first roller, a first knife roller and a first conveyor belt connecting the first roller and the first knife roller, a rinsing device including a net drum and two second rollers arranged under the net drum, the two second rollers being drivingly connected with the net drum, three water reservoirs with an open top arranged within the net drum and each pivotally mounted on an axle longitudinally extending across the net drum, and eleven spraying pipes disposed above the net drum and each provided with a plurality of perforations, and a squeezing device including a second knife roller, two third roller, a second conveyor belt, two upper squeezing rollers and two lower squeezing rollers, whereby the cloths are washed one by one.

It is the primary object of the present invention to provide a rolling drum type washing structure of a washing apparatus machine which can clean the cloth thoroughly.

It is another object of the present invention to provide a rolling drum type washing structure of a washing apparatus which is provided with ironing and folding devices.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
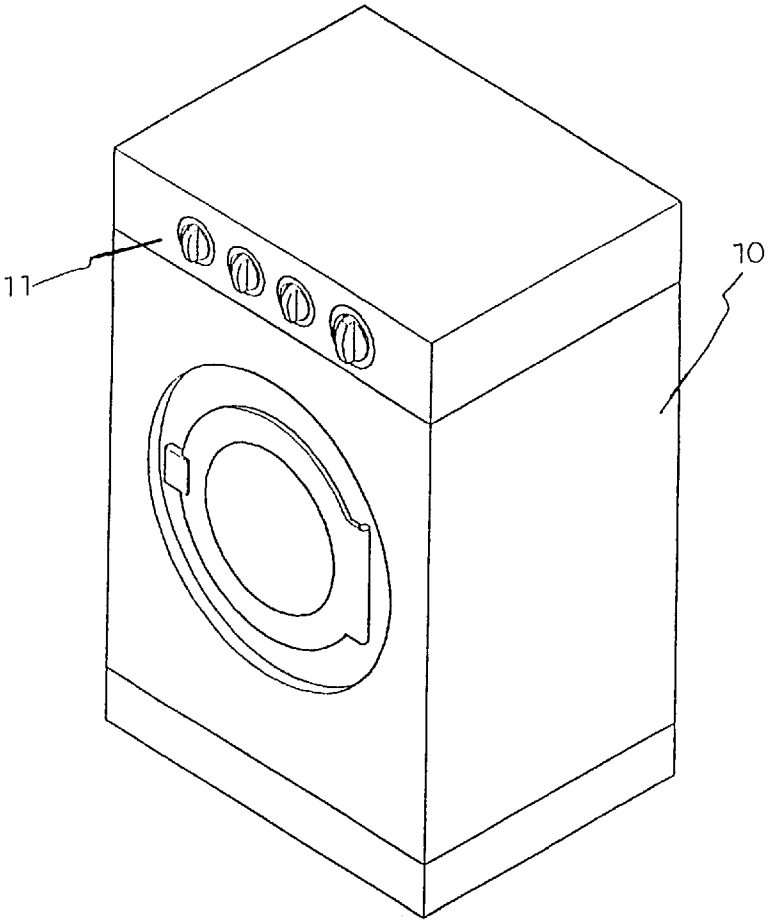
(PRIOR ART) FIG. 1
FIG. 1 is a prior art rolling type washing machine.
Figure 2:
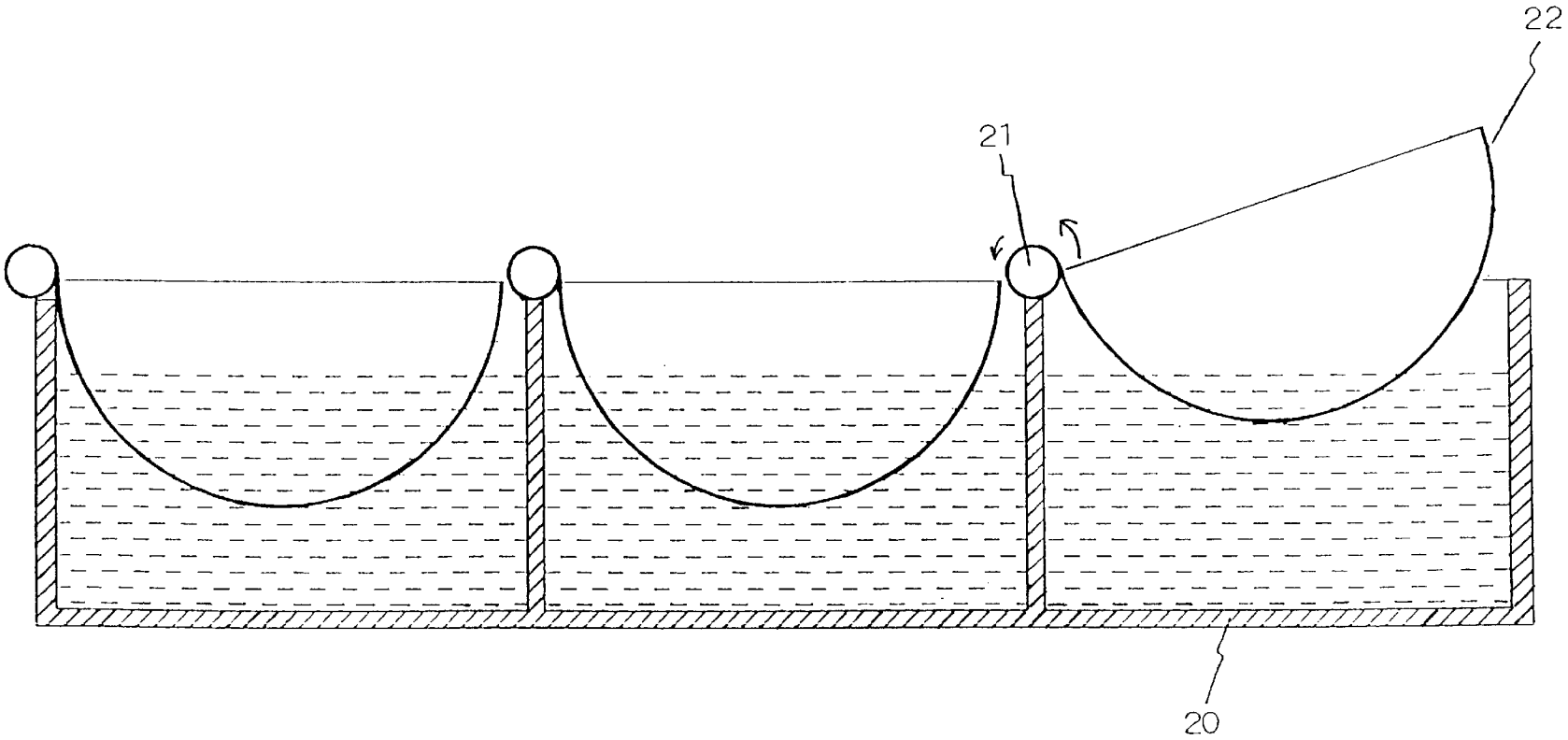
(PRIOR ART) FIG. 2
FIG. 2 is a prior art tunnel type washing machine.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 3:
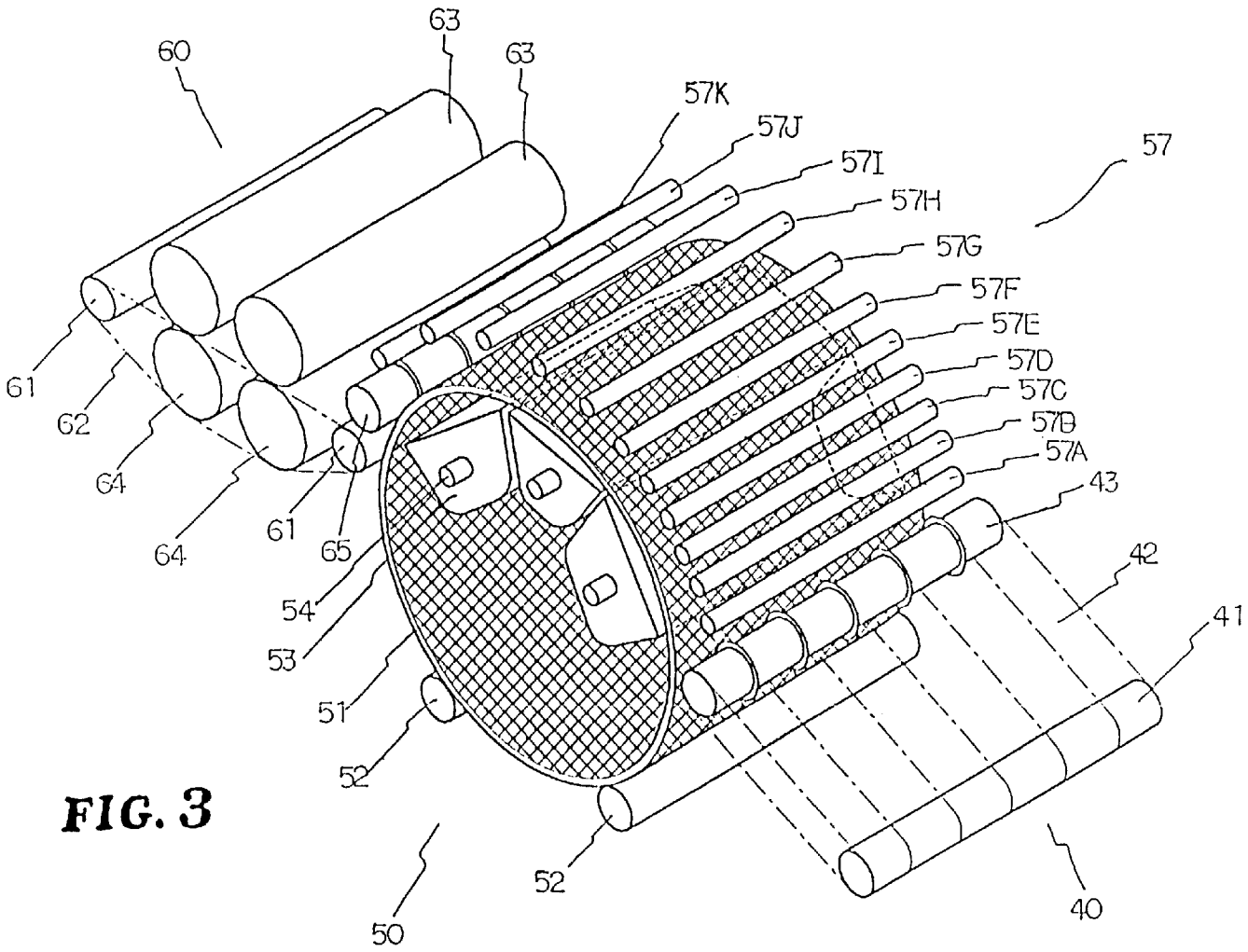
FIG. 3 is a perspective view of a rolling drum type washing structure of a washing apparatus according to the present invention.
Figure 4:
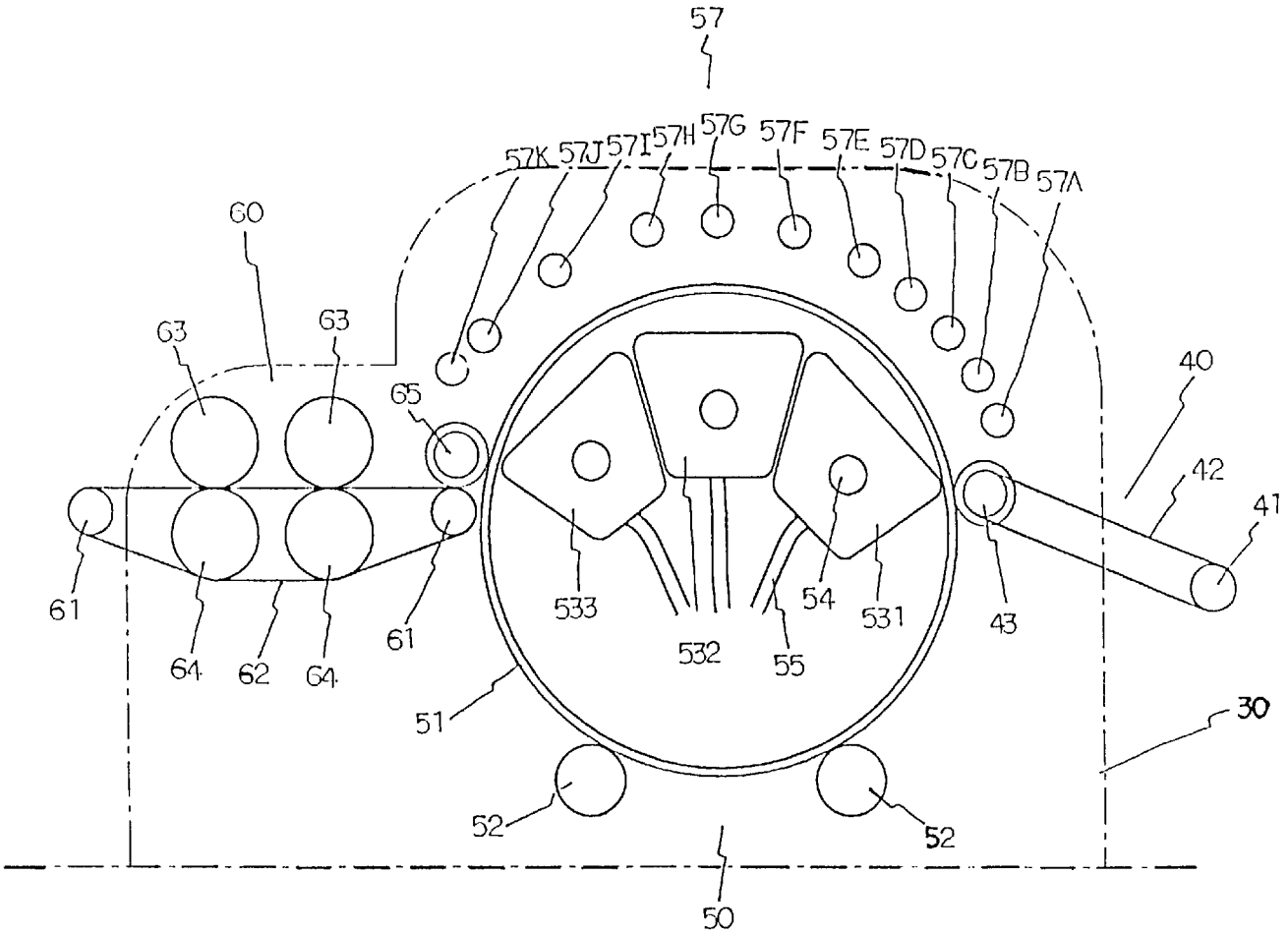
FIG. 4 is a front view of the present invention.

With reference to the drawings and in particular to FIGS. 3 and 4 thereof, the rolling drum type washing structure of a cloth washing apparatus according to the present invention is arranged within a housing (not shown) on which there are a control panel (not shown), an inlet (not shown) and an outlet (not shown). The rolling drum type washing structure generally comprises a transmission device 40, a rinsing device 50 and a squeezing device 60.

The transmission device 40 includes a roller 41, a knife roller 43 and a conveyor belt 42. The knife roller 43 is disposed in contact with the lower portion of the net drum 51 of the rinsing device 50 and mainly used for transmitting bed sheets, tablecloths, clothes or the like to the rinsing device 50.

The rinsing device 50 includes a net drum 51 and two rollers 52 arranged under the net drum 51. The two rollers 52 are driven by a motor (not shown) so that the rollers 52 will drive the net drum 51 to rotate when the motor is turned on. Within the net drum 51 there are three water reservoirs 53 with an open top. The water reservoir 53 is pivotally mounted on an axle 54 longitudinally extending across the net drum 51. Two ends of the axle 54 are journalled by suitable means so that the water reservoirs 53 will not be influenced when net drum 51 is rotated. The bottom of each of the water reservoirs 53 is connected to a cyclic supplying device (not shown) via a pipe 55 so that the water in the water reserviors 53 may be transmitted to the cyclic supplying device. Eleven spraying pipes 57 are longitudinally mounted above the net drum 51 and each provided with a plurality of perforations. The eleven spraying pipes 57 are also connected to the cyclic supplying device.

The squeezing device 60 includes a knife roller 65, a roller 61, a conveyor belt 62, two upper squeezing rollers 63 and two lower squeezing rollers 64. The knife roller 65 is arranged in contact with the net drum 51 of the rinsing device 50. The upper squeezing rollers 63 are mounted on the upper side of the conveyor belt 2, while the lower squeezing rollers 64 are arranged under the upper squeezing rollers 63 and within the conveyor belt 62. Hence, when a piece of cloth passes between the upper and lower rollers 63 and 64, the cloth will be squeezed thereby removing water therefrom.

By means of the above-mentioned means, the cloth is put on the conveyor belt 42 of the transmission device 40 through an inlet of the housing of the washing machine (not shown) and then the cloth is transmitted to the rinsing device 50 behind the transmission device 40 by the rotation of the roller 41.

As a cloth enters into the rinsing device 50, the cloth will be first arranged on the surface of the net drum 51 so that the cloth will be rotated in unison with the net drum 51 thereby passing through the spraying pipes 57. Meanwhile, the first spraying pipe 57A will spray fog-like cleaning agent on the cloth, the second spraying pipe 57B will wet the cloth, the third spraying pipe 57C, will eject steam to the cloth, the fourth spraying pipe 57D will eject bleaching agent to the cloth, and the fifth to eleventh spraying pipes 57E, 57F, 57G, 57I, 57J and 57K will eject strong water streams to the cloth, so that the cloth will be thoroughly cleaned after rotating about a half circle with the net drum 51. Thereafter, the cloth is transmitted to the squeezing device 60 behind the net drum 51.

After the cloth enters into the squeezing device 60, the cloth will be placed on the conveyor belt 62 which will be driven by the rollers 61 to transmit the cloth to pass through the two pairs of squeezing rollers 63 and 64 thereby drying the cloth.

The three water reservoirs 53 are used for collecting water from the eleven spraying pipes 57, wherein the water ejected by the spraying pipes 57I, 57J and 57K is clean so that the water collected by the third water reservoir 533 will be retrieved by the cyclic water supplying device which will then supply the water to the fifth to seventh spraying pipes 57E, 57F and 57G. The water ejected by the sixth to eighth spraying pipes 57F, 57G and 57H will be collected by the second water reservoir 532 and retrieved by the cyclic water supplying device and then mixed with cleaning agent and bleaching agent to supply to the first to fourth spraying pipes 57A, 57B, 57C and 57D. The water ejected by the first to fifth spraying pipes 57A, 57B, 57C, 57D and 57E are waste water with chemicals, and collected by the first water reservoir 531 which will discharge the waste water through the a drain pipe 55.

Figure 5:
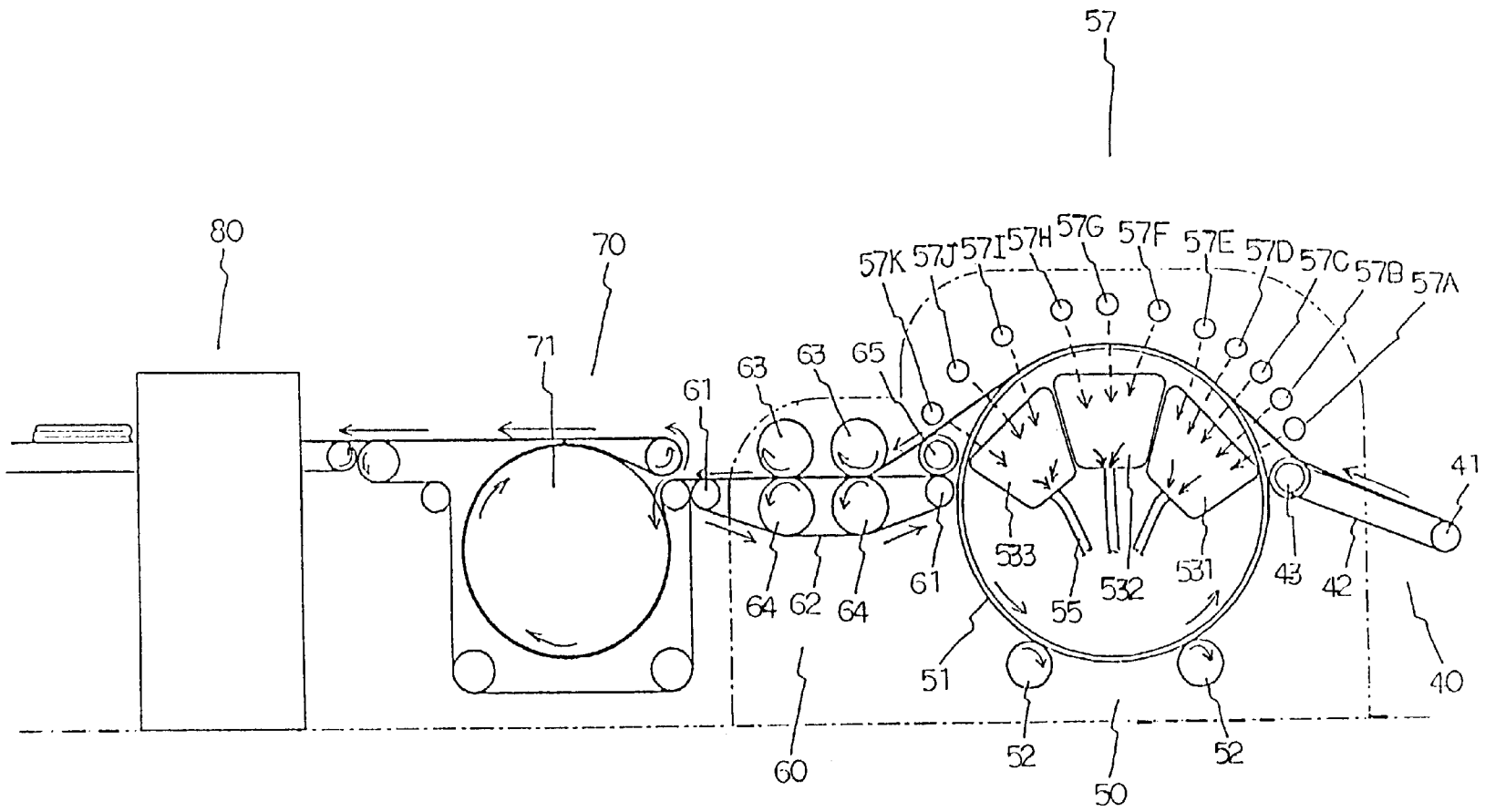
FIG. 5 is a working view of the present invention.

Referring to FIG. 5, the ironing device 70 is arranged behind the squeezing device 60 and the folding device 80 is in turned mounted behind the ironing device 70, so that the cloth after being cleaned will be transmitted to the ironing device 70 for being ironed by a heating drum 71 and then the cloth is transmitted to the folding machine 80 for folding.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A rolling drum type washing structure for a washing apparatus comprising:

a transmission device including a first roller, a first knife roller and a first conveyor belt connecting said first roller and said first knife roller;

a rinsing device including a net drum and two second rollers arranged under said net drum, said two second rollers being drivingly connected with said net drum, three water reservoirs with an open top arranged within said net drum and each pivotally mounted on an axle longitudinally extending across said net drum, and eleven spraying pipes disposed above said net drum and each provided with a plurality of perforations, first one of said eleven spraying pipes being used for ejecting cleaning agent to a cloth, second one of said eleven spraying pipes being used for ejecting water to wet said cloth, third one of said eleven spraying pipes being used for ejecting steam to said cloth, fourth one of said eleven spraying pipes being used for ejecting bleaching agent to said cloth, fifth to eleventh ones of said eleven spraying pipes being used for ejecting strong water stream to said cloth, and said net drum being disposed adjacent to said first knife roller; and a squeezing device including a second knife roller, two third rollers, a second conveyor belt, two upper squeezing rollers and two lower squeezing rollers, said second knife roller being arranged in contact with said net drum of said rinsing device, said upper and lower squeezing rollers being mounted on an upper side of said conveyor belt and within said second belt under said upper squeezing rollers.

* * * * *